US008873983B2

(12) United States Patent
Taki et al.

(10) Patent No.: US 8,873,983 B2
(45) Date of Patent: Oct. 28, 2014

(54) IMAGE FORMING APPARATUS AND IMAGE FORMING METHOD

(75) Inventors: Kenji Taki, Toyokawa (JP); Junichi Arai, Chiryu (JP); Kazuo Okunishi, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 114 days.

(21) Appl. No.: 13/614,536

(22) Filed: Sep. 13, 2012

(65) Prior Publication Data

US 2013/0084091 A1 Apr. 4, 2013

(30) Foreign Application Priority Data

Sep. 30, 2011 (JP) ..... 2011-217853

(51) Int. Cl.
*G03G 15/20* (2006.01)
*G03G 15/00* (2006.01)

(52) U.S. Cl.
CPC ..... *G03G 15/55* (2013.01); *G03G 15/2064* (2013.01); *G03G 15/2078* (2013.01); *G03G 15/2046* (2013.01); *G03G 15/2067* (2013.01); *G03G 15/2003* (2013.01)
USPC ..... 399/67; 399/70

(58) Field of Classification Search
CPC ..... G03G 15/00
USPC ..... 399/67
See application file for complete search history.

(56) References Cited

U.S. PATENT DOCUMENTS

| | | | | |
|---|---|---|---|---|
| 5,701,554 | A | 12/1997 | Tanaka et al. | |
| 5,758,228 | A * | 5/1998 | Hirose et al. | 399/70 |
| 6,018,140 | A * | 1/2000 | Hirose et al. | 219/216 |
| 2004/0126127 | A1 * | 7/2004 | Fujimori et al. | 399/70 |

FOREIGN PATENT DOCUMENTS

| | | | | |
|---|---|---|---|---|
| JP | 59-062883 | A | 4/1984 | |
| JP | H08-146814 | * | 6/1996 | G03G 15/20 |
| JP | H08-146814 | A | 6/1996 | |
| JP | 2001-051533 | * | 2/2001 | G03G 15/20 |
| JP | 2001-051533 | A | 2/2001 | |
| JP | 2004-126191 | A | 4/2004 | |
| JP | 2004-279835 | A | 10/2004 | |
| JP | 2006-023424 | * | 1/2006 | G03G 15/20 |
| JP | 2006-023424 | A | 1/2006 | |

OTHER PUBLICATIONS

Office Action (Notification of Reasons for Refusal) issued Oct. 22, 2013, by the Japanese Patent Office in corresponding Japanese Patent Application No. 2011-217853, and an English Translation of the Office Action. (6 pages).

* cited by examiner

*Primary Examiner* — Clayton E LaBalle
*Assistant Examiner* — Kevin Butler
(74) *Attorney, Agent, or Firm* — Buchanan Ingersoll & Rooney PC

(57) ABSTRACT

An image forming apparatus for fixing a toner image to a recording sheet by transporting the recording sheet through a fixing nip formed by a heating rotating body and a pressing rotating body that press against each other. The image forming apparatus includes an idle rotation unit that causes idle rotation of the heating rotating body and the pressing rotating body during a standby state of the image forming apparatus, a cumulative amount recording unit that measures an amount of the idle rotation and record a cumulative amount of the idle rotation, and a prohibiting unit that prohibits the idle rotation unit from causing the idle rotation when the cumulative amount reaches a predetermined allowable value.

20 Claims, 9 Drawing Sheets

FIG. 9

Energy-saving / quiet settings

Time before switching to energy-saving mode

[20] minutes (0~9999)

Time limit for noise during standby

[30] minutes (0~9999)

Quiet after cancellation of energy-saving mode

[ON ▾] (ON or OFF)

IMAGE FORMING APPARATUS AND IMAGE FORMING METHOD

This application is based on an application No. 2011-217853 filed in Japan, the contents of which are hereby incorporated by reference.

BACKGROUND OF THE INVENTION (1) Field of the Invention

The present invention relates to an image forming apparatus and an image forming method, and in particular to technology for reducing noise generated during standby.

(2) Description of the Related Art

Halogen lamp fixing devices fix toner images to recording sheets by passing recording sheets through a fixing nip formed where a pressing roller presses against a fixing roller that has a halogen lamp provided therein as a source of heat. The fixing roller may, for example, be a metal bar that encloses a halogen lamp and whose outer circumferential surface is covered by an elastic layer made of silicone rubber or the like. The pressing roller is also a metal bar whose outer circumferential surface is covered by an elastic layer made of silicone rubber or the like.

During standby, i.e. while the image forming apparatus is waiting to print, the fixing roller and the pressing roller continue to press against each other without rotating. If heat from the fixing roller is transferred to the pressing roller in this state via the fixing nip, only the portion of the pressing roller at the fixing nip will heat up, whereas other portions will gradually dissipate heat and cool down. This is because the silicone rubber forming the elastic layer of the pressing roller has low thermal conductance, making it difficult for heat to be transferred to portions of the pressing roller other than at the fixing nip. Such a situation leads to temperature variation in the circumferential direction along the outer surface of the pressing roller.

Therefore, when printing after returning from a standby state, unevenness in fixing may occur due to temperature variation along the pressing roller. One approach to resolve this problem is to cause the fixing roller and the pressing roller to idly rotate during standby. Doing so allows the heat from the fixing roller to be transferred evenly across the outer circumferential surface of the pressing roller, thus preventing temperature variation, which in turn prevents uneven fixing.

Technology has also been proposed to place a halogen lamp inside the pressing roller as well and to heat the pressing roller while causing the rollers to rotate idly. In this case, in order to prevent hot offset caused by excessive heat from the fixing roller or the like, the length of time of idle rotation is adjusted based on a predicted value of accumulated heat of the fixing roller and the like (see Japanese Patent Application Publication No. 20044-26191).

A problem occurs, however, in that if the fixing roller and other rollers rotate idly when the image forming apparatus is not printing, the user may find the resulting operation noise to be unpleasant. This problem is particularly salient in settings such as an office in which people do desk work for long hours, as it is difficult to avoid hearing the noise if the image forming apparatus is located nearby.

SUMMARY OF THE INVENTION

The present invention has been conceived in light of the above problems, and it is an object thereof to provide an image forming apparatus and an image forming method that control uneven fixing caused by temperature variation of the pressing roller while reducing noise caused by idle rotation of rollers such as the fixing roller.

In order to achieve the above object, an image forming apparatus according to the present invention is for fixing a toner image to a recording sheet by transporting the recording sheet through a fixing nip formed by a heating rotating body and a pressing rotating body that press against each other, the image forming apparatus comprising: an idle rotation unit configured to cause idle rotation of the heating rotating body and the pressing rotating body during a standby state of the image forming apparatus; a cumulative amount recording unit configured to measure an amount of the idle rotation and record a cumulative amount of the idle rotation; and a prohibiting unit configured to prohibit the idle rotation unit from causing the idle rotation when the cumulative amount reaches a predetermined allowable value.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 9 illustrates an example of a display on the operation panel to let the user of the image forming apparatus 1 indicate whether to reset the rotation timer when the energy-saving mode is canceled.

DESCRIPTION OF THE PREFERRED EMBODIMENTS

With reference to the drawings, the following describes an image forming apparatus and an image forming method according to aspects of the present invention.

1. Structure of Image Forming Apparatus

First, the structure of an image forming apparatus according to the present embodiment is described.

Figure 1:
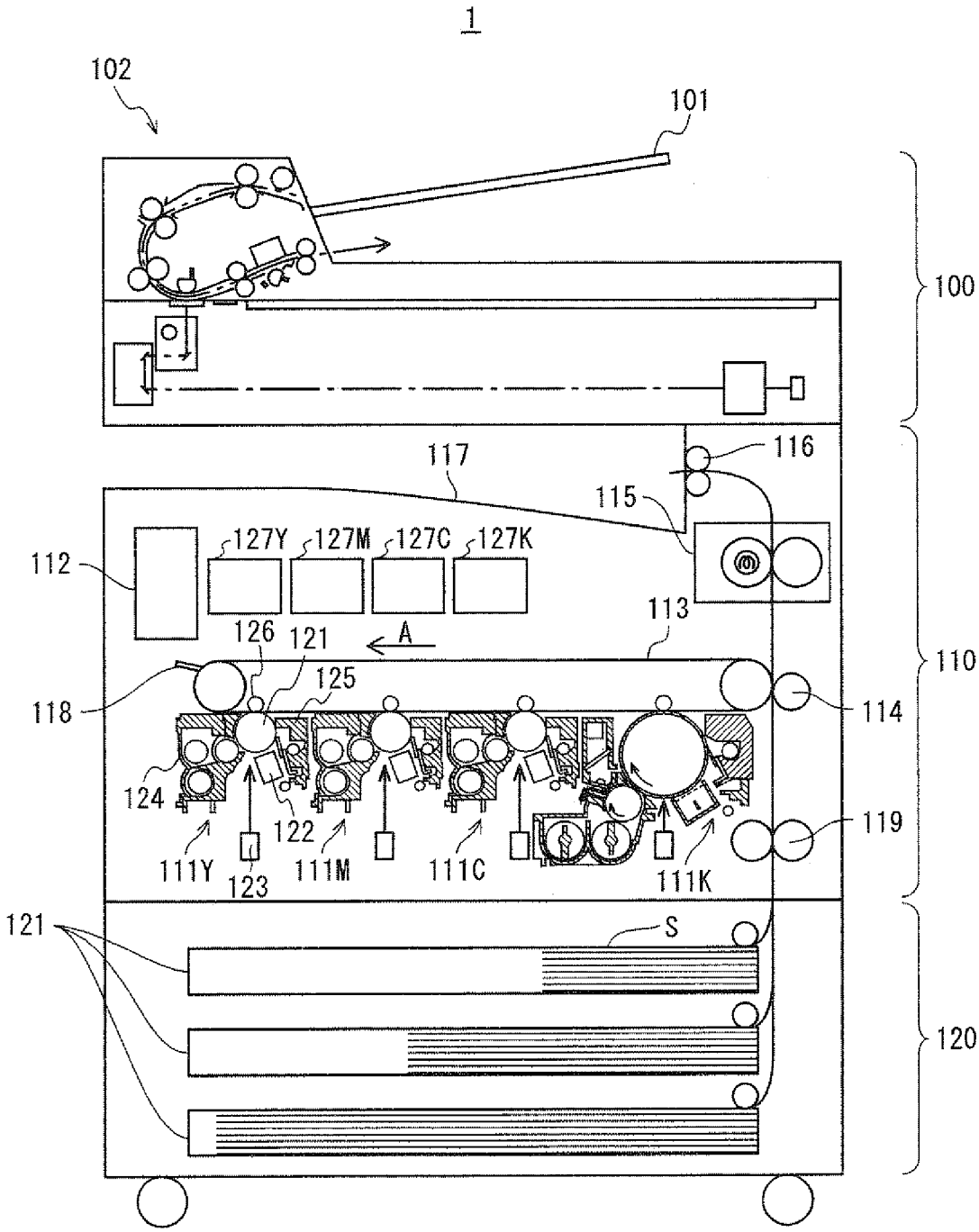
FIG. 1 illustrates the main structure of an image forming apparatus 1 according to an embodiment of the present invention.

FIG. 1 illustrates the main structure of an image forming apparatus according to the present embodiment. As shown in FIG. 1, the image forming apparatus 1 is a tandem-type color Multi Function Peripheral (MFP) and is provided with an original reading unit 100, an image forming unit 110, and a sheet feeder 120. The original reading unit 100 generates image data by optically reading originals that are placed in an original tray 101 and fed by an Automatic Document Feeder (ADF) 102. The image data is stored in a controller 112 described below.

The image forming unit 110 is provided with image creating units 111Y through 111K, the controller 112, an intermediate transfer belt 113, a pair of secondary transfer rollers 114, a fixing device 115, a pair of discharge rollers 116, a discharge tray 117, a cleaning blade 118, and a pair of timing rollers 119. Toner cartridges 127Y through 127K to provide Y (yellow), M (magenta), C (cyan), and K (black) color toner are mounted in the image forming unit 110.

The image creating units 111Y through 111K receive toner supplied by the respective toner cartridges 127Y through 127K and form YMCK color toner images under the control of the controller 112. For example, the image creating unit 111Y is provided with a photoconductive drum 121, a charging device 122, an exposure device 123, a developing device 124, and a cleaning device 125. Under the control of the controller 112, the charging device 122 uniformly charges the outer circumferential surface of the photoconductive drum 121. The exposure device 123 forms an electrostatic latent image on the outer circumferential surface of the photoconductive drum 121 by exposing the surface in accordance with image data.

The developing device 124 provides toner to the outer circumferential surface of the photoconductive drum 121 to develop (visualize) the electrostatic latent image. Transfer voltage is applied to a primary transfer roller 126, and by electrostatic adsorption, the toner image on the outer circumferential surface of the photoconductive drum 121 is electrostatically transferred (primary transfer) to the intermediate transfer belt 113. Subsequently, the cleaning device 125 first scrapes residual toner off the outer circumferential surface of the photoconductive drum 121 with a cleaning blade and then neutralizes the outer circumferential surface with a neutralization lamp.

The image creating units 111M through 111K similarly form MCK color toner images and perform primary transfer to the intermediate transfer belt 113 so that the toner images overlap one another. The intermediate transfer belt 113 is an endless rotating body that rotates in the direction of the arrow A and transports the toner image after primary transfer to the pair of secondary transfer rollers 114.

The sheet feeder 120 is provided with paper cassettes 121 storing recording sheets S by size. The sheet feeder 120 feeds the recording sheets S to the image forming unit 110. The recording sheets S are fed one sheet at a time in parallel with the transport of the toner image by the intermediate transfer belt 113. Each recording sheet is transported to the pair of secondary transfer rollers 114 via the pair of timing rollers 119. The pair of timing rollers 119 is formed by a pair of rollers and adjusts the timing at which the recording sheet S reaches the pair of secondary transfer rollers 114.

The pair of secondary transfer rollers 114 is composed of a pair of rollers having a potential difference due to application of secondary transfer voltage. These rollers form a transfer nip by pressing against each other. The toner image on the intermediate transfer belt 113 is electrostatically transferred (secondary transfer) to the recording sheet S at the transfer nip. After transfer of the toner image, the recording sheet S is transported to the fixing device 115. After secondary transfer, the toner remaining on the intermediate transfer belt 113 is subsequently transported in the direction of the arrow A, is scraped off by the cleaning blade 118, and is discarded.

The fixing device 115 fuses the toner image with heat and pressure bonds the toner image to the recording sheet S. The recording sheet S with the toner image fused thereon is ejected by the pair of discharge rollers 116 into the discharge tray 117. The controller 112 controls the operations of the image forming apparatus 1, which also includes an operation panel not shown in the figures. The controller 112 exchanges image data with other devices, such as a Personal Computer (PC), and receives print jobs. The controller 112 also receives and transmits facsimile data over a facsimile line.

Note that when removing toner remaining on the intermediate transfer belt 113, a cleaning brush or cleaning roller may be used instead of the cleaning blade 118.

2. Structure of Controller 112

Next, the structure of the controller 112 is described.

Figure 2:
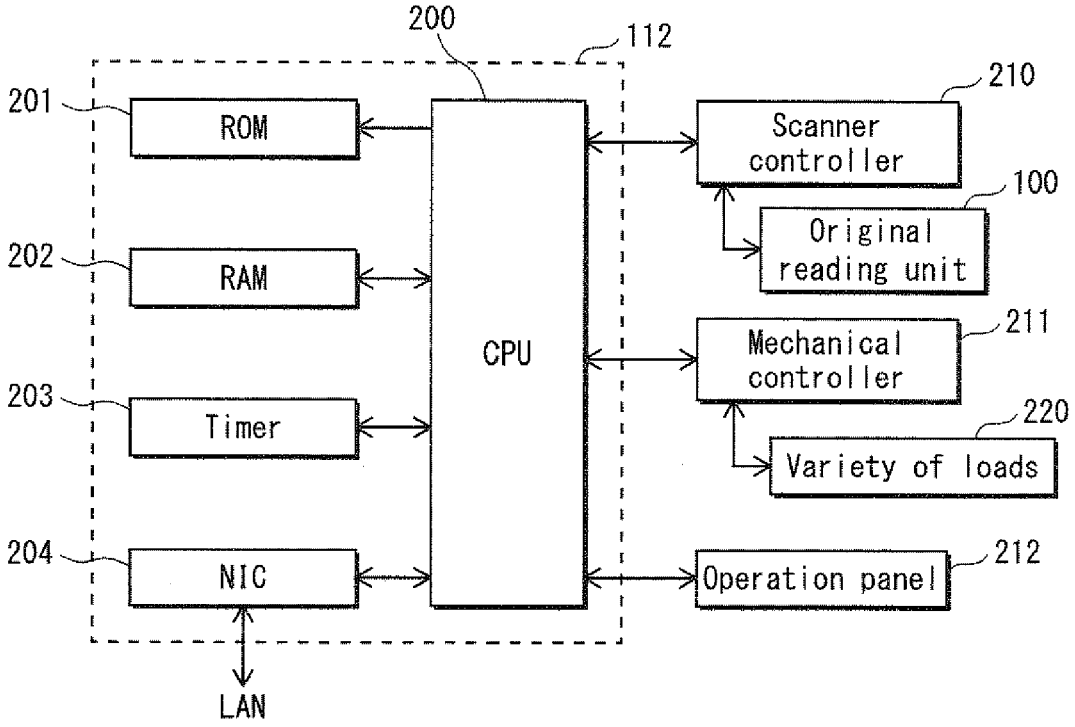
FIG. 2 is a block diagram illustrating the main structure of a controller 112.

FIG. 2 is a block diagram illustrating the main structure of the controller 112. As shown in FIG. 2, the controller 112 is provided with a Central Processing Unit (CPU) 200, Read Only Memory (ROM) 201, Random Access Memory (RAM) 202, a timer 203, and a Network Interface Card (NIC) 204. The controller 112 communicates with a scanner controller 210, a mechanical controller 211, and an operation panel 212.

When the power is turned on, the CPU 200 reads a control program and control parameters from the ROM 201 and executes the control program using the RAM 202 as a working storage region. The CPU 200 starts and stops a timer 203 in accordance with the control program in order to measure time. The NIC 204 is controlled by the CPU 200 to exchange data with other devices, such as PCs, over a Local Area Network (LAN). This exchange allows the controller 112 to receive print instructions from PCs.

Via the seamier controller 210, the controller 112 causes the original reading unit 100 to read an original and generate image data. The controller 112 also controls a variety of loads 220 via the mechanical controller 211. The loads 220 are, for example, motors that cause rollers, such as the pair of secondary transfer rollers 114, the pair of discharge rollers 116, the pair of timing rollers 119, or the primary transfer roller 126 to rotate; a laser for exposing the photoconductive drum 121; a fixing heater provided in the fixing device 115; a high-voltage power supply for applying high-power voltage to components such as the charging device 122; and the like.

Furthermore, the controller 112 displays information to the user of the image forming apparatus 1 and receives input of user instructions via the operation panel 212.

3. Structure of Fixing Device 115

Next, the overall structure of the fixing device 115 is described.

Figure 3:
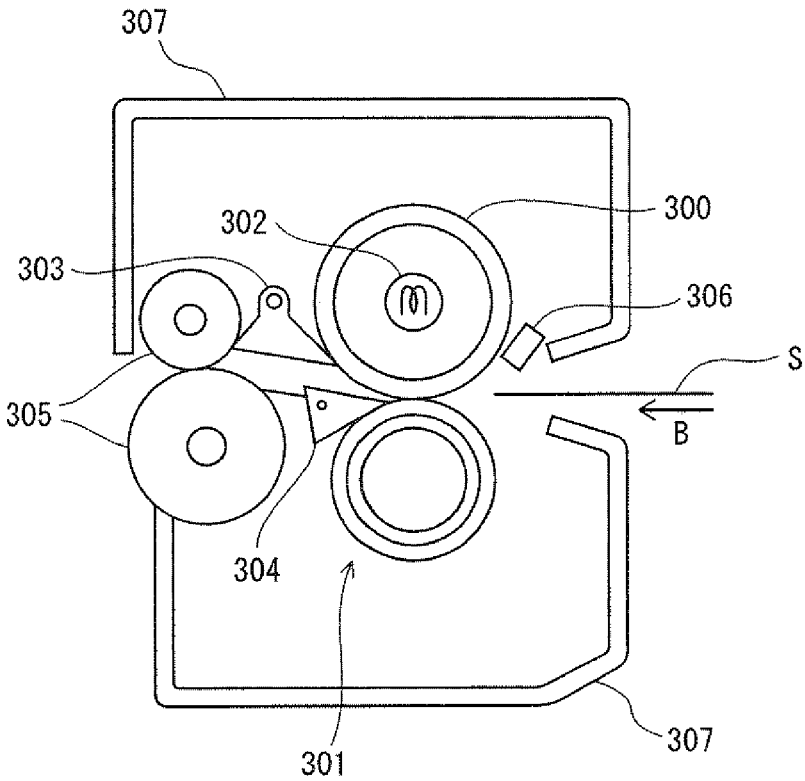
FIG. 3 is a cross-section diagram illustrating the main structure of a fixing device 115.

FIG. 3 is a cross-section diagram illustrating the main structure of the fixing device 115. As shown in FIG. 3, the fixing device 115 is provided with a fixing roller 300, a pressing roller 301, a halogen lamp 302, separation claws 303 and 304, a pair of transport rollers 305, an infrared non-contact temperature sensor 306, and a housing 307 that houses these components.

The fixing roller 300 encloses the halogen lamp 302 as a fixing heater. The pressing roller 301 is caused to press against the fixing roller 300 by a biasing mechanism not shown in the figures, thereby forming the fixing nip. In the present embodiment, the pressing roller 301 is a simple structure that is not provided with a heater. Rather, the pressing roller 301 is heated via the fixing roller 300 with heat from the halogen lamp 302 by the rollers being caused to rotate idly for a predetermined amount of time when no sheet is being passed through the fixing nip.

The separation claws 303 and 304 are provided downstream in the direction of sheet transportation so that the tips thereof are respectively in contact with the surface of the fixing roller 300 and the surface of the pressing roller 301. The tips of the separation claws 303 and 304 engage with the tip of a sheet S that passes through the fixing nip in order to separate the sheet S from the surface of the rollers.

After being separated by the separation claws 303 and 304, the sheet S is transported further downstream by the pair of transport rollers 305. The non-contact temperature sensor 306 detects the surface temperature of the fixing roller 300.

4. Operations of the Controller 112

Next, the operations of the controller 112 are described, focusing in particular on the control of idle rotation by the fixing roller 300 and the pressing roller 301. First, typical operations of the controller 112 are described before describing additional processes individually.

i. Typical Operations of the Controller 112

Figure 4:
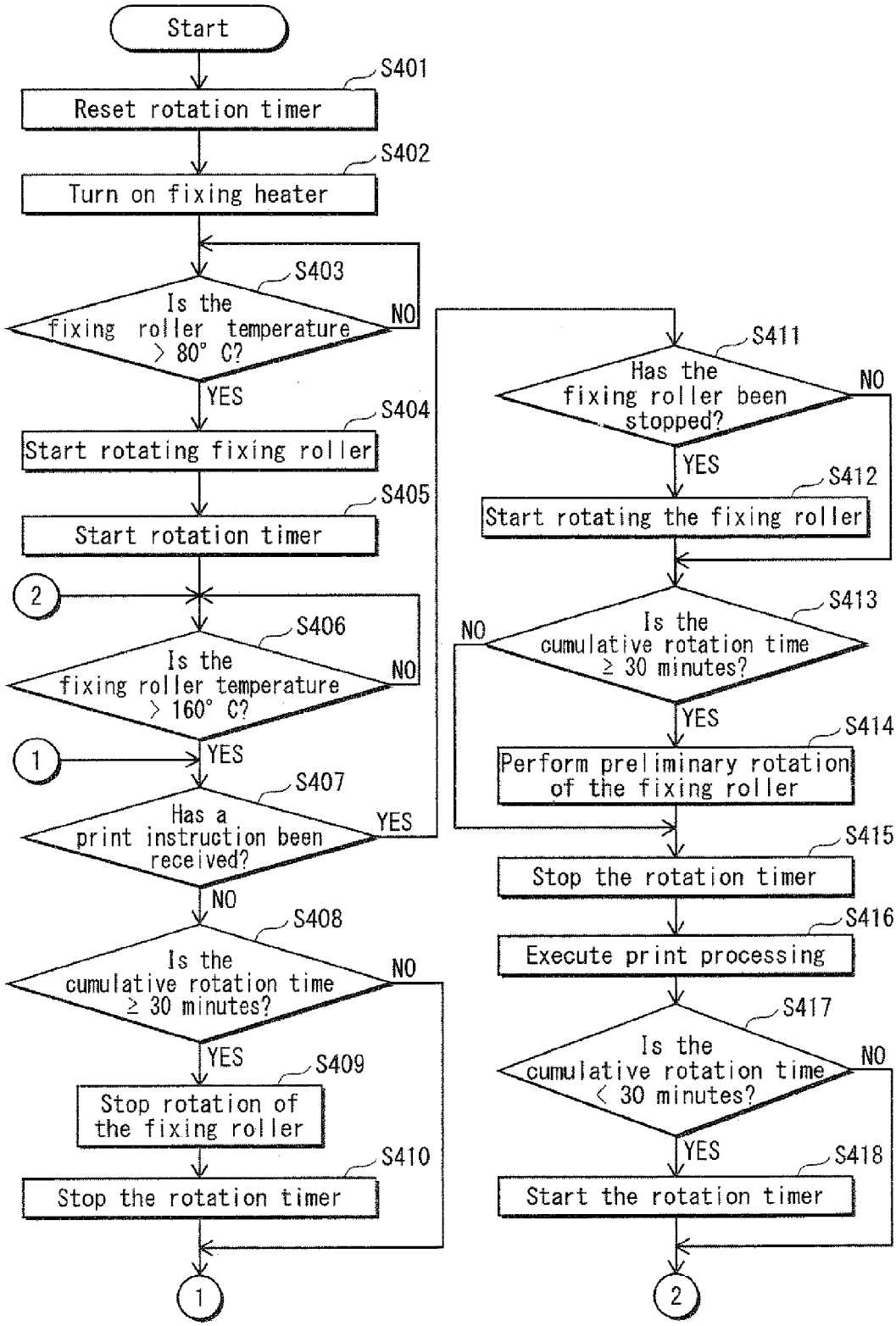
FIG. 4 is a flowchart showing typical operations of the controller 112.

FIG. 4 is a flowchart illustrating typical operations of the controller 112. As shown in FIG. 4, when the power is turned on, the controller 112 first resets a rotation timer (S401). The rotation timer is a timer for measuring the cumulative amount of time the fixing roller 300 has been rotating idly (hereinafter referred to as the "cumulative rotation time"). In step S401, the value of the timer is reset to zero.

Next, the controller 112 turns the fixing heater on (S402) and monitors the temperature of the fixing roller 300 using the non-contact temperature sensor 306. If the temperature of the fixing roller 300 exceeds 80° C. (S403: YES), the controller 112 begins to rotate the fixing roller 300 (S404). During fixing, since the fixing roller 300 is in direct contact with the image formation side of the recording sheet, a portion of the toner on the recording sheet sometimes attaches to the outer circumferential surface of the fixing roller 300 and remains attached thereto. When such residual toner attaches to the image formation side of the next recording sheet to be fixed, image noise occurs. To prevent such image noise, a cloth referred to as a web is brought into contact with the fixing roller 300 and used to wipe off any residual toner.

At the beginning of the warm-up period, the temperature of the fixing roller 300 is still low. Residual toner that is wiped off with the web may therefore act as an adhesive, causing the web to attach to the outer circumferential surface of the fixing roller 300. In this case, further rotation of the fixing roller 300 will strain the web and may cause the web to tear. To prevent damage to the web, the fixing roller 300 is not rotated until the temperature of the fixing roller 300 exceeds 80° C., as this allows for rotation after any residual toner is softened by the heat of the fixing roller 300.

Simultaneously with the start of rotation of the fixing roller 300, the rotation timer begins to measure the cumulative rotation time (S405). Subsequently, after the temperature of the fixing roller 300 exceeds 160° C. (S406: YES), if no print instruction has been received (S407: NO), the controller 112 refers to the rotation timer. If the cumulative rotation time is 30 minutes or greater (S408: YES), the controller 112 stops rotation of the fixing roller 300 in order to prevent the occurrence of noise (S409) and also suspends measurement by the rotation timer (S410). After step S410, or when the cumulative rotation time has not reached 30 minutes (S408: NO), processing returns to step S407, and the above steps are repeated. Note that the threshold of "30 minutes" is, for example, stored in the ROM 201.

When a print instruction is received (S407: YES), the controller 112 first determines whether rotation of the fixing roller 300 has been stopped. If rotation of the fixing roller 300 has been stopped (S411: YES), the controller 112 causes the fixing roller 300 to rotate (S412). After step S412, or when the fixing roller 300 is already rotating (S411: NO), the controller 112 refers to the rotation timer.

If the cumulative rotation time indicated by the rotation timer is 30 minutes or greater (S413: YES), it can be assumed that the temperature of the fixing roller 300 has fallen due to the fixing roller 300 not rotating idly. Therefore, before executing a printing process, the controller causes the fixing roller 300 to rotate for 10 seconds. This preliminary rotation allows the temperature of the fixing roller 300 to rise (S414). After step S414, or when the cumulative rotation time is less than 30 minutes (S413: NO), the controller 112 suspends the rotation timer (S415) and executes the printing process (S416).

After completion of the printing process, the controller 112 refers to the rotation timer. If the cumulative rotation time is less than 30 minutes (S417: YES), the controller restarts the rotation timer in order to continue measuring the cumulative time of idle rotation (S418). If the cumulative rotation time is at least 30 minutes (S417: NO), the fixing roller 300 is not idly rotated, nor is the rotation timer restarted. Subsequently, processing returns to step S406, and the above steps are repeated.

With this structure, idle rotation is maintained from the time power to the image forming apparatus 1 is turned on until the cumulative time of idle rotation reaches 30 minutes. This both prevents unevenness in fixing and reduces the First Copy Out Time (FCOT). Note that after the temperature of the fixing roller 300 exceeds 160° C., a standby mode is entered whereby the heater is controlled to turn on and off in order to maintain a temperature of 160° C., thus maintaining a read-to-print state.

In this context, idle rotation refers to rotation of the fixing roller 300 and the pressing roller 301 other than when these rollers are rotated during a printing process, and to when these rollers are rotated during a standby state. The standby state refers to a warm-up state, a standby mode, and an energy-saving mode which is described below. The warm-up state extends from the start of rotation of the fixing roller 300 until transition to the standby mode. Furthermore, a printing process refers to the sequence of operations by the image forming apparatus 1 from reception of a print instruction through fixing of a toner image on a transported recording sheet S.

In the present embodiment, idle rotation of the fixing roller 300 begins after the temperature of the fixing roller 300 exceeds 80° C. and continues during the standby mode, with the cumulative rotation time being measured. Alternatively, the cumulative rotation time may be measured for idle rotation during the standby state after completion of printing. Note that the FCOT refers to the time from when an image forming apparatus receives a print instruction until output of the first recording sheet.

When the cumulative time of idle rotation exceeds 30 minutes, suspending idle rotation prevents the occurrence of noise. In the present embodiment, after idle rotation is suspended, unevenness in fixing is prevented by preliminary rotation before the print processing.

ii. Trigger for Reheating Other Than a Print Instruction

The image forming apparatus 1 may heat the fixing roller 300 due to an event other than a print instruction, such as when detecting that a user is touching the operation panel (i.e. a panel touch), or when detecting that the paper cassette has been removed and reinserted. The fixing roller 300 may also be caused to rotate when performing image stabilization processing. The following describes operations by the controller 112 in such cases. Note that the following focuses on the differences from the above-described typical operations.

Figure 5:
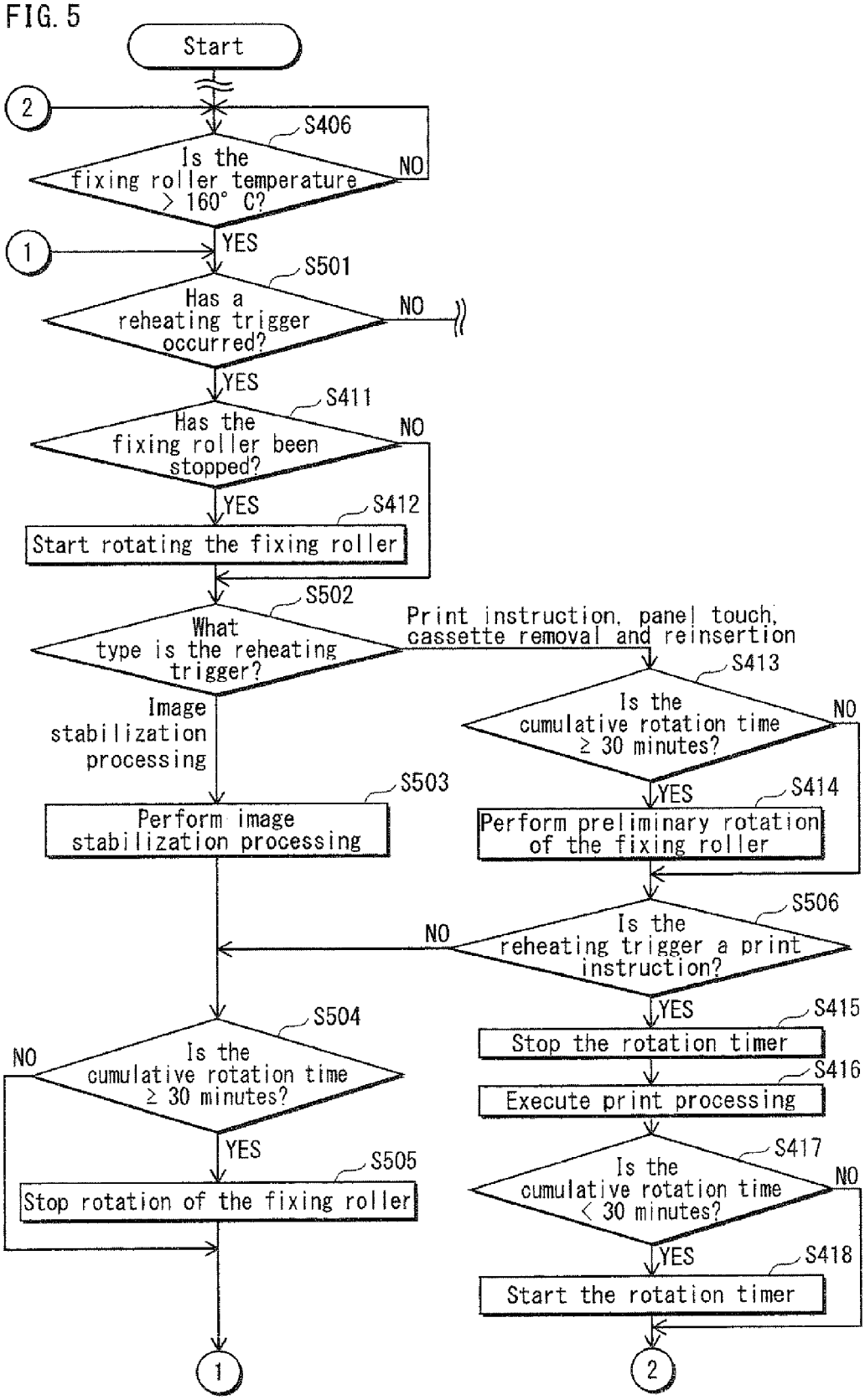
FIG. 5 is a flowchart illustrating operations of the controller 112 when a reheating trigger other than a print instruction occurs.

FIG. 5 is a flowchart illustrating operations of the controller 112 when a reheating trigger other than a print instruction occurs. In FIG. 5, steps that correspond to FIG. 4 are labeled with the same numbers. Furthermore, a description of steps in FIG. 5 that correspond to steps S401 through S405 and S408 through S410 in FIG. 4 is omitted.

As shown in FIG. 5, if the temperature of the fixing roller exceeds 160° C. (S406: YES), and if no reheating trigger has occurred (S501: NO), processing from the above step S408 through step S410 is performed. If a reheating trigger has occurred (S501: YES), the controller 112 checks whether rotation of the fixing roller 300 has been stopped. If so (S411: YES), the controller 112 causes the fixing roller 300 to rotate (S412).

Subsequently, if the reheating trigger is image stabilization processing (S502: image stabilization processing), the controller 12 performs the image stabilization processing (S503). Image stabilization processing refers to processing to maintain the image formed by the image forming apparatus 1 at a high quality. Periodically, or when environmental changes in temperature, humidity, or the like are detected, process conditions (such as charge voltage and transfer current) are automatically optimized by forming a toner patch on the photoconductive drum 121 and measuring the density of the toner patch.

The formation of the toner patch during image stabilization processing necessarily emits operation sounds (noise) that are roughly the same as during print processing. Therefore, even if the fixing roller 300 is idly rotated at the same time as the image stabilization processing, the noise produced by idle rotation is not noticeable. Taking advantage of this fact, the fixing roller 300 may be caused to idly rotate during image stabilization processing in order to prevent unevenness in fixing while avoiding an increase in the FCOT.

Subsequently, the controller 112 refers to the rotation timer and, if the cumulative rotation time is at least 30 minutes (S504: YES), stops rotation of the fixing roller 300 (S505). Otherwise (S504: NO), the controller 112 maintains idle rotation of the fixing roller 300. Processing then returns to step S501, and the above steps are repeated.

If the reheating trigger is a print instruction, a panel touch, or cassette removal and reinsertion (S502: print instruction, panel touch, cassette removal and reinsertion), the controller 112 refers to the rotation timer. If the cumulative rotation time is at least 30 minutes (S413: YES), the controller 112 causes the fixing roller 300 to undergo 10 seconds of preliminary rotation in order to prevent unevenness in fixing (S414).

After the preliminary rotation of the fixing roller 300, or when the cumulative rotation time is less than 30 minutes (S413: NO), the controller 112 checks whether the reheating trigger is a print instruction. If the reheating trigger is a print instruction (S506: YES), the controller 112 performs the same processing as in the above steps S415 through S418, and processing then proceeds to step S406.

If the reheating trigger is not a print instruction, but rather a panel touch or cassette removal and reinsertion (S506: NO), the controller 112 refers to the rotation timer to check value of the cumulative rotation time. If the cumulative rotation time is at least 30 minutes (S504: YES), the controller 112 stops rotation of the fixing roller 300 (S505). Otherwise (S504: NO), processing proceeds to step S501, and the above processing is repeated. In the case of a panel touch or cassette removal and reinsertion, the controller 112 operates in this way because there is no need to stop idle rotation of the fixing roller 300 if the cumulative rotation time is not at least 30 minutes.

iii. Operations for Energy-Saving Mode

Next, operations of the controller 112 for the energy-saving mode are described. After completion of the print process, when 20 minutes have passed since entering standby mode, the controller 112 according to the present embodiment switches to the energy-saving mode. The period from when the power is turned on until the temperature of the fixing roller 300 reaches 160° C. is set as the warm-up state. Once the fixing roller 300 reaches 160° C., the controller 112 enters the standby mode. At this point, if 20 minutes pass without a print instruction, the controller 112 switches the image forming apparatus 1 to the energy-saving mode. Note that the setting of "20 minutes" is, for example, stored in the ROM 201.

The reason for setting the standby time until switching to the energy-saving mode (the continuous time in the standby mode) to be 20 minutes, which is shorter than the 30-minute upper limit on the cumulative time of idle rotation, is to prevent extending the FCOT by not stopping idle rotation from when the power is turned on until the controller 112 first enters the energy-saving mode. Such operation fulfills the users' expectation that the FCOT will not be extended before the image forming apparatus enters the energy-saving mode, like conventional apparatuses.

During the energy-saving mode, energy consumption is reduced by turning off the fixing heater. Every four hours after the start of the energy-saving mode, the fixing heater is turned on and the fixing roller 300 is rotated for 30 seconds. This reduces the FCOT by reducing the warm-up time necessary when returning from the energy-saving mode to execute print processing.

Figure 6:
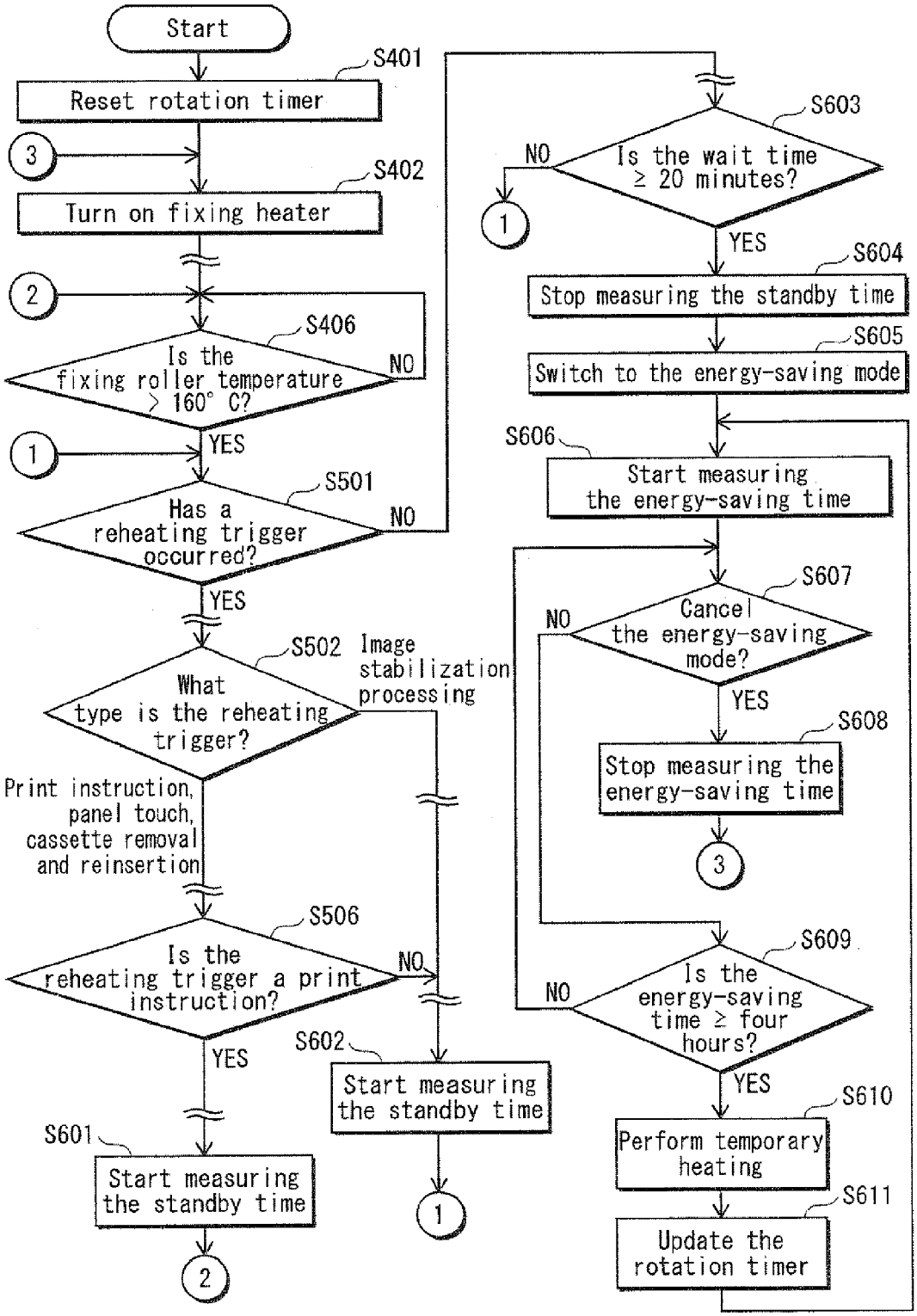
FIG. 6 is a flowchart illustrating operations of the controller 112 related to an energy-saving mode.

FIG. 6 is a flowchart illustrating operations of the controller 112 related to the energy-saving mode. In FIG. 6, steps that correspond to FIGS. 4 and 5 are labeled with the same numbers. Furthermore, a description of steps that correspond to steps S403 through S405 and S408 through S418 in FIG. 4 is omitted from FIG. 6. A description of steps corresponding to steps S503 through S505 in FIG. 5 is also omitted.

As shown in FIG. 6, when switching to the standby mode after the controller 112 determines in step S417 that the cumulative rotation time is at least 30 minutes (S417: NO), or after the processing in step S418, the controller 112 begins measuring the standby time (S601), and processing proceeds to step S406. Also when switching to the standby mode after the controller 112 determines in step S504 that the cumulative rotation time is not at least 30 minutes (S504: NO), or after the processing in step S505, the controller 112 begins measuring the standby time (S602), and processing proceeds to step S501.

After the controller 112 determines in step S417 that the cumulative rotation time is not at least 30 minutes (S417: NO), or after the processing in step S418, if the standby time has not reached 20 minutes (S603: NO), processing proceeds to step S501. If the standby time is at least 20 minutes (S603: YES), the controller 112 switches to the energy-saving mode (S605). In other words, the controller 112 stops measuring the standby time (S604), stops rotation of the fixing roller 300, suspends the rotation timer, and turns off the fixing heater. Furthermore, upon switching to the energy-saving mode, the controller 112 begins measuring the consecutive time spent in the energy-saving mode (hereinafter referred to as "energy-saving time"; S606).

Subsequently, if an event that causes the energy-saving mode to be canceled occurs, i.e. if a reheating trigger occurs (S607: YES), the controller 112 stops measuring the energy-saving time (S608), and processing proceeds to step S402. If the controller 112 does not cancel the energy-saving mode (S607: NO), then if the energy-saving time is at least four hours (S609: YES), the controller 112 performs temporary heating (S610). The temporary heating in the present embodiment is processing to turn the fixing heater on, rotate the fixing roller 300 for 30 seconds, suspend the fixing roller 300, and then turn the fixing heater off.

Rotation of the fixing roller 300 during the temporary heating obviously produces operation sounds (noise). Therefore, this rotation is also considered part of the idle rotation, and the 30 seconds that the rotation lasts are added to the rotation timer (S611). After step S611, measurement of the energy-saving time begins again in order to determine the timing of the next temporary heating (S606). If the energy-saving time has not reached four hours (S609: NO), processing proceeds to step S607. The controller 112 then monitors for the occurrence of an event that causes cancellation of the energy-saving mode.

iv. Usage Example

Next, as an example of typical usage of the image forming apparatus 1 according to the present embodiment, an example of usage in an average office is described.

Figure 7:
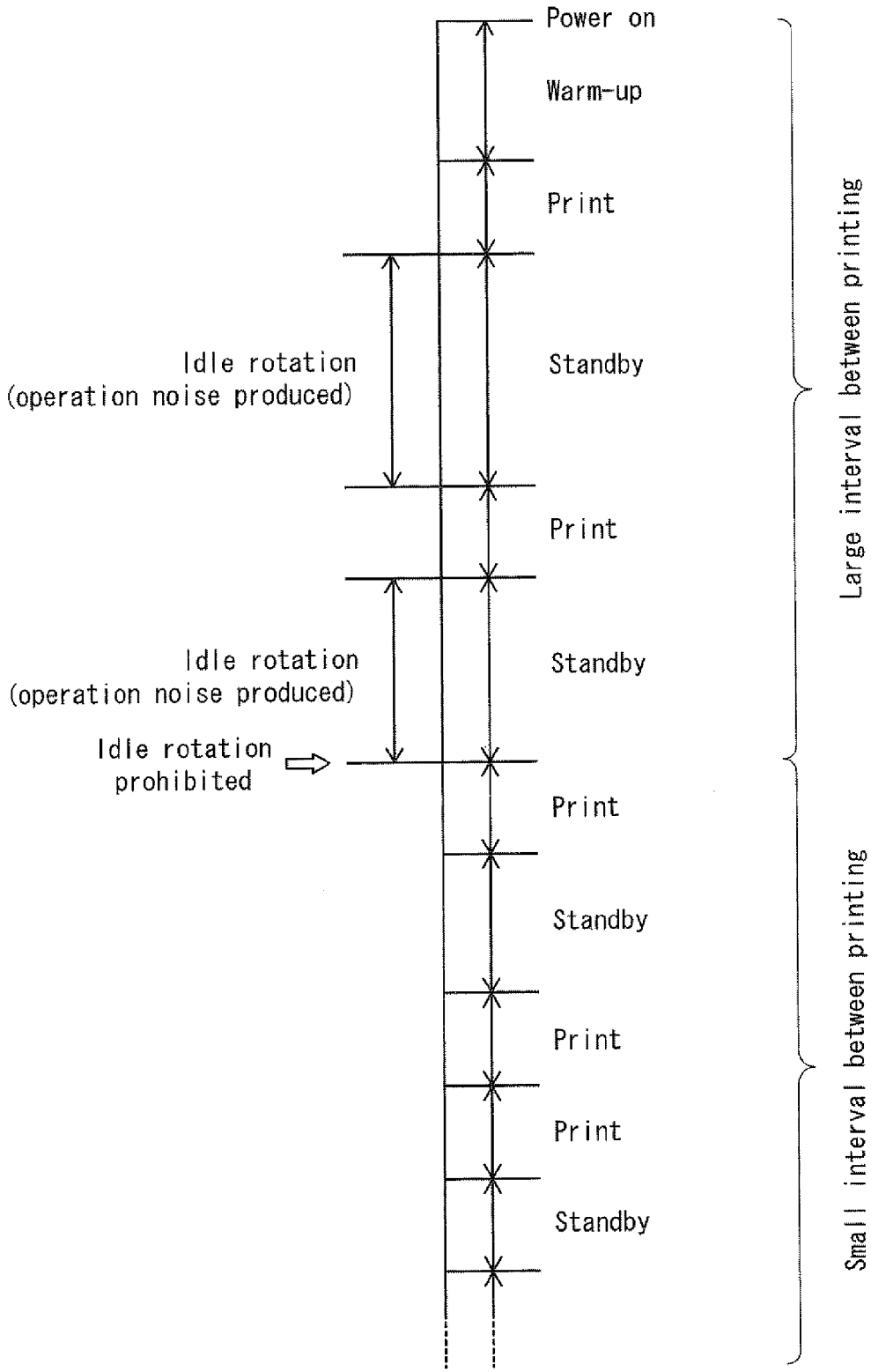
FIG. 7 illustrates a typical example of usage of the image forming apparatus 1 in an ordinary office.

FIG. 7 illustrates a typical example of usage of the image forming apparatus 1 in an average office. As illustrated in FIG. 7, in an average office, the power is turned on at the start of the workday, and the image forming apparatus begins warming up. After the start of the workday, however, it normally takes some time before employees finish creating documents to print. It is therefore uncommon for the image forming apparatus to be used fully right at the start of the day. This means that the interval between printing is long at the start of the day.

In the image forming apparatus 1 of the present embodiment, idle rotation is maintained until the cumulative time of idle rotation reaches 30 minutes. As a result, at the beginning of the day, when the interval between printing is long, the idle rotation prevents unevenness in fixing. Subsequently, just as more documents to print are being prepared and the interval between printing is growing shorter, the cumulative time of idle rotation reaches 30 minutes, at which point idle rotation is prohibited. At this point in time, however, the interval between printing is short, which hinders the occurrence of unevenness in fixing. The need for idle rotation is therefore reduced.

Furthermore, as flextime has become more common in recent years, the number of workers in an office is often low at the start of the day, reaching a peak during the core time when workers must be present. Early in the day, when few workers are present, the operation sound (noise) produced by idle rotation affects few people. On the other hand, such noise during the core time has a much greater affect. The image forming apparatus 1 of the present embodiment prohibits idle rotation as the core time approaches, thereby minimizing the effect of the operation noise.

5. Modifications

Figure 8:
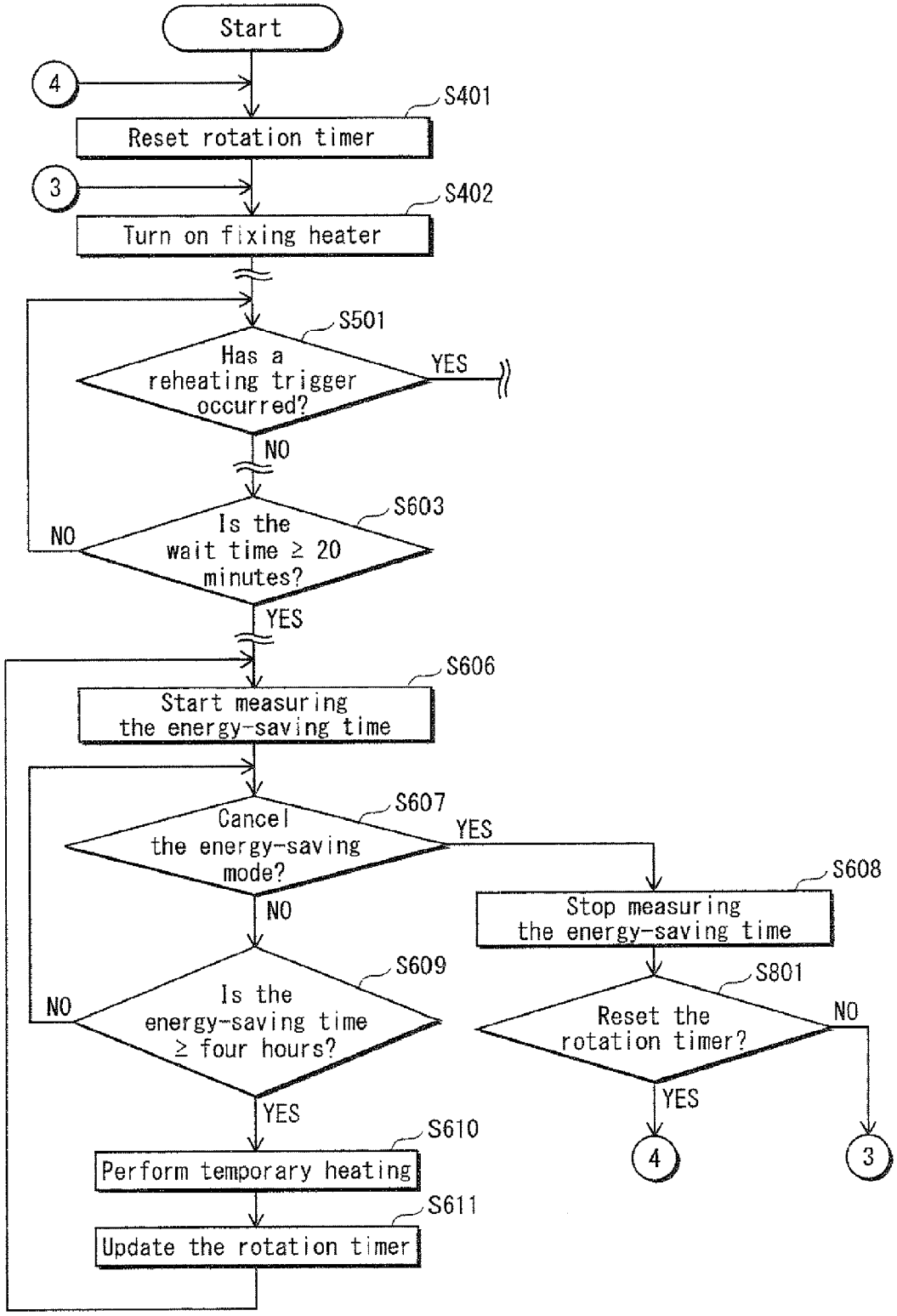
FIG. 8 is a flowchart illustrating operations of the controller 112 according to a modification of the present invention.

While an embodiment of the present invention has been described, the present invention is of course not limited to the above embodiment. For example, the above operations of the controller 112 are not limited to print processing based on a print instruction from a PC and may of course be similarly performed for print processing to copy an original using the original reading unit 100. The following modifications are also possible.

i. In the above embodiment, the rotation timer is described as being reset only when the power is turned on, but the present invention is of course not limited in this way. Instead, the user of the image forming apparatus 1 may for example be asked to indicate whether to reset the rotation timer when returning from the energy-saving mode. FIG. 8 is a flowchart illustrating operations of the controller 112 according to the present modification. Steps in which the controller 112 performs the same operations as in the above embodiment are labeled with the same numbers, and a description thereof is omitted.

As shown in FIG. 8, when the controller 112 of the present modification cancels the energy-saving mode (S607: YES) and stops measuring the energy-saving time (S608), the controller 112 refers to a user setting. If the user setting indicates to reset the rotation timer (S801: YES), processing proceeds to step S401 and after resetting the rotation timer, the controller 112 turns the fixing heater on. Conversely, if the user setting indicates not to reset the rotation timer (S801: NO), processing proceeds to step S402, in which the controller 112 turns the fixing heater on.

FIG. 9 illustrates an example of a display on the operation panel to let the user of the image forming apparatus 1 indicate whether to reset the rotation timer when the energy-saving mode is canceled. When the setting for "Quiet after cancellation of energy-saving mode" is set to ON, as illustrated in FIG. 9, the rotation timer is not reset, and idle rotation continues to be prohibited. Conversely, if the "Quiet after cancellation of energy-saving mode" is set to OFF, the rotation timer is reset to prioritize reduction of unevenness in fixing.

In FIG. 9, the "time before switching to energy-saving mode" indicates the time it takes to switch to energy-saving mode after entering the standby mode (in the above embodiment, 20 minutes), and the "time limit for noise during standby" indicates the duration of idle rotation before idle rotation is prohibited (in the above embodiment, 30 minutes). The user is allowed to set both of these times. The settings are stored in a nonvolatile memory provided in the controller 112 and are referred to in steps S408, S413, S417, S504, and S603.

If the energy-saving mode continues for an extended period of time (such as overnight), the heat accumulated in the fixing device 115 may be dramatically reduced, almost to the same degree as if the power were turned off. Subsequently, if the image forming apparatus 1 intermittently receives print instructions, the FCOT may be long. With the present modification, users that dislike such an extended. FCOT can cause the rotation timer to be reset upon returning from the energy-saving mode. This prevents the lengthening of the FCOT, thereby allowing the image forming apparatus 1 to operate in accordance with user preference.

If the default value of the "Quiet after cancellation of energy-saving mode" setting is ON, the rotation timer is only reset when the power is turned on. This promotes noise reduction during standby mode after returning from the energy-saving mode. Conversely, if the default value is set to OFF, the rotation timer is reset each time after returning from the energy-saving mode. The fixing roller 300 therefore rotates idly, which reduces the FCOT.

ii. In the above embodiment, the cumulative rotation time after which idle rotation is prohibited is set to 30 minutes, but the present invention is of course not limited in this way. A different value may instead be used. In a typical office, it is preferable for the cumulative rotation time to be longer than the standby time before switching to the energy-saving mode, as described in the above modification.

Furthermore, since the user that turns on the power to the image forming apparatus at the start of the day needs to print, the noise due to idle rotation will not particularly bother the user. As described in the above embodiment, in an office with a flextime policy, the number of workers right at the start of the day is expected to be few.

Moreover, the power to the image forming apparatus is typically turned on at the start of the day approximately an hour and a half before the core time of the flextime system begins. Therefore, in order to prohibit the generation of operation sound (noise) due to idle rotation before the maximum number of workers arrive in the office, it can be considered effective to set the cumulative rotation time for prohibiting idle rotation to be 50 minutes or less, which is the result of subtracting the time taken up by print operations from the above hour and a half.

iii. In the above embodiment, use of a tinier to measure times such as the cumulative rotation time is described, but the present invention is of course not limited in this way. A means other than a timer may be used to measure times such as the cumulative rotation time. For example, a counter that increments periodically, such as every five milliseconds, may be used. Instead of starting and stopping a timer, the counter may be started and stopped in order to measure the cumulative rotation time. Alternatively, the rotation angle of the fixing roller 300 and the pressing roller 301 may be measured. The advantageous effects of the present invention can be achieved regardless of the method for measuring times such as the cumulative rotation time.

iv. In the above embodiment, an example of a fixing device with a halogen lamp is described, but the present invention is of course not limited in this way. The present invention may be applied to a fixing device of a type that does not incorporate a halogen lamp in order to achieve the advantageous effects of the present invention.

v. In the above embodiment, a tandem-type color MFP is described as an example of the image forming apparatus, but the present invention is of course not limited in this way. The present invention may be adopted in a color MFP that is not tandem-type, or in a monochrome MFP. The advantageous effects of the present invention can also be achieved by adopting the present invention in a device with a single function, such as a printer, a copier, or a facsimile device.

vi. The present invention of course includes an image forming method executed by the image forming apparatus of the above embodiment.

6. Advantageous Effects

As described above, the image forming apparatus according to an aspect of the present invention is for fixing a toner image to a recording sheet by transporting the recording sheet through a fixing nip formed by a heating rotating body and a pressing rotating body that press against each other, the image forming apparatus comprising: an idle rotation unit configured to cause idle rotation of the heating rotating body and the pressing rotating body during a standby state of the image forming apparatus; a cumulative amount recording unit configured to measure an amount of the idle rotation and record a cumulative amount of the idle rotation; and a prohibiting unit configured to prohibit the idle rotation unit from causing the idle rotation when the cumulative amount reaches a predetermined allowable value.

With this structure, the idle rotation of the heating rotating body is prohibited when the cumulative amount of the idle rotation reaches the allowable value. Therefore, after power is turned on to the image forming apparatus and the frequency of print instructions gradually increases, this structure both prevents the occurrence of unevenness in fixing and while minimizing the operating sound (noise) caused by idle rotation.

The image forming apparatus may further comprise a preliminary rotation unit configured to cause preliminary rotation of the heating rotating body and the pressing rotating body before a print process when the image forming apparatus executes the print process after the prohibiting unit prohibits the idle rotation. This structure prevents the occurrence of unevenness in fixing after idle rotation is prohibited.

With regard to measurement of the amount of idle rotation, the cumulative amount recording unit may measure a duration of the idle rotation as the amount of the idle rotation and record a cumulative duration as the cumulative amount of the idle rotation. Alternatively, the cumulative amount recording unit may measure, as the amount of the idle rotation, a rotational distance traveled by one of the heating rotating body and by the pressing rotating body circumferentially along an outer circumferential surface thereof and record a cumulative rotational distance as the cumulative amount of the idle rotation.

In an image forming apparatus that remains in the energy-saving mode for a an extended period of time without the power being turned off, it is preferable that the image forming apparatus further comprise an energy-saving unit configured to cause the image forming apparatus to transition to an energy-saving state that consumes less power than the standby state when, during the standby state, a predetermined transition time elapses without reception of a print instruction, wherein after the transition to the energy-saving state, the cumulative amount recording unit resets the cumulative amount to zero when a predetermined prohibition cancellation time elapses during the energy-saving state.

The image forming apparatus may further comprise an energy-saving unit configured to cause the image forming apparatus to transition to an energy-saving state that consumes less power than the standby state when, during the standby state, a predetermined transition time elapses without reception of a print instruction; and an energy-saving state rotation unit configured to cause idle rotation, when a predetermined fixing cool down time elapses during the energy-saving state, of the heating rotating body and the pressing rotating body for a predetermined energy-saving state rotation time and then to cause the image forming apparatus to return to the energy-saving state, wherein the cumulative amount recording unit also measures the amount of idle rotation caused by the energy-saving state rotation unit for inclusion in the cumulative amount of the idle rotation. This structure further reduces the occurrence of noise.

When converted to represent idle rotation time, the allowable value may be in a range of at least 30 minutes and at most 50 minutes. Furthermore, the image forming apparatus may further comprise an energy-saving unit configured to transition to an energy-saving state that consumes less power than the standby state when, during the standby state, a predetermined transition time elapses without reception of a print instruction, wherein when converted to represent idle rotation time, the allowable value is longer than the transition time. This structure prevents an increase in the FCOT between when the power is turned on and the image forming apparatus transitions to the energy-saving state for the first time.

Furthermore, in most environments where the image forming apparatus is used, such as offices, the power is turned on at the beginning of the day, and print instructions are generated in a certain cycle throughout the day. Therefore, it is preferable that the cumulative amount recording unit reset the cumulative amount to zero when power is provided to the image forming apparatus.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus for fixing a toner image to a recording sheet by transporting the recording sheet through a fixing nip formed by a heating rotating body and a pressing rotating body that press against each other, the image forming apparatus comprising:

an idle rotation unit configured to cause idle rotation of the heating rotating body and the pressing rotating body during a standby state of the image forming apparatus;

a cumulative amount recording unit configured to measure an amount of the idle rotation and record a cumulative amount of the idle rotation;

an energy-saving unit configured to cause the image forming apparatus to transition to an energy-saving state that consumes less power than the standby state when, during the standby state, a predetermined transition time elapses without reception of a print instruction;

a setting unit configured to set whether to reset the cumulative amount when the image forming apparatus returns from the energy-saving state;

a resetting unit configured to reset the cumulative amount when the image forming apparatus returns from the energy-saving state only in a case where the setting unit sets to reset the cumulative amount when the image forming apparatus returns from the energy-saving state; and a prohibiting unit configured to prohibit the idle rotation unit from causing the idle rotation when the cumulative amount reaches a predetermined allowable value.

2. The image forming apparatus of claim 1, further comprising:

a preliminary rotation unit configured to cause preliminary rotation of the heating rotating body and the pressing rotating body before a print process when the image forming apparatus executes the print process after the prohibiting unit prohibits the idle rotation.

3. The image forming apparatus of claim 1, wherein the cumulative amount recording unit measures a duration of the idle rotation as the amount of the idle rotation and records a cumulative duration as the cumulative amount of the idle rotation.

4. The image forming apparatus of claim 1, wherein the cumulative amount recording unit measures, as the amount of the idle rotation, a rotational distance traveled by one of the heating rotating body and by the pressing rotating body circumferentially along an outer circumferential surface thereof and records a cumulative rotational distance as the cumulative amount of the idle rotation.

5. The image forming apparatus of claim 1, wherein after the transition to the energy-saving state, the cumulative amount recording unit resets the cumulative amount to zero when a predetermined prohibition cancellation time elapses during the energy-saving state.

6. The image forming apparatus of claim 1, further comprising:

an energy-saving state rotation unit configured to cause idle rotation, when a predetermined fixing cool down time elapses during the energy-saving state, of the heating rotating body and the pressing rotating body for a predetermined energy-saving state rotation time and then to cause the image forming apparatus to return to the energy-saving state, wherein the cumulative amount recording unit also measures the amount of idle rotation caused by the energy-saving state rotation unit for inclusion in the cumulative amount of the idle rotation.

7. The image forming apparatus of claim 1, wherein when converted to represent idle rotation time, the predetermined allowable value is in a range of at least 30 minutes and at most 50 minutes.

8. The image forming apparatus of claim 1, wherein when converted to represent idle rotation time, the predetermined allowable value is longer than the transition time.

9. The image forming apparatus of claim 1, wherein the cumulative amount recording unit resets the cumulative amount to zero when power is provided to the image forming apparatus.

10. The image forming apparatus of claim 1, further comprising:

an input receiving unit configured to receive input from a user to set whether to reset the cumulative amount when the image forming apparatus returns from the energy-saving state, wherein the setting unit sets whether to reset the cumulative amount based on the input received by the input receiving unit.

11. An image forming method executed by an image forming apparatus for fixing a toner image to a recording sheet by transporting the recording sheet through a fixing nip formed by a heating rotating body and a pressing rotating body that press against each other, the image forming method comprising:

an idle rotation step of causing idle rotation of the heating rotating body and the pressing rotating body during a standby state of the image forming apparatus;

a cumulative amount recording step of measuring an amount of the idle rotation and recording a cumulative amount of the idle rotation;

an energy-saving step configured to cause the image forming apparatus to transition to an energy-saving state that consumes less power than the standby state when, during the standby state, a predetermined transition time elapses without reception of a print instruction;

a setting step configured to set whether to reset the cumulative amount when the image forming apparatus returns from the energy-saving state;

a resetting step configured to reset the cumulative amount when the image forming apparatus returns from the energy-saving state only in a case where the setting step sets to reset the cumulative amount when the image forming apparatus returns from the energy-saving state; and a prohibiting step of prohibiting idle rotation during the idle rotation step when the cumulative amount reaches a predetermined allowable value.

12. The image forming method of claim 11, further comprising:

a preliminary rotation step of causing preliminary rotation of the heating rotating body and the pressing rotating body before a print process when the image forming apparatus executes the print process after the prohibiting step.

13. The image forming method of claim 11, wherein the cumulative amount recording step measures a duration of the idle rotation as the amount of the idle rotation and records a cumulative duration as the cumulative amount of the idle rotation.

14. The image forming method of claim 11, wherein the cumulative amount recording step measures, as the amount of the idle rotation, a rotational distance traveled by one of the heating rotating body and by the pressing rotating body circumferentially along an outer circumferential surface thereof and records a cumulative rotational distance as the cumulative amount of the idle rotation.

15. The image forming method of claim 11, further comprising:

after the transition to the energy-saving state, the cumulative amount recording step resets the cumulative amount to zero when a predetermined prohibition cancellation time elapses during the energy-saving state.

16. The image forming method of claim 11, further comprising:

an energy-saving state rotation step configured to cause idle rotation, when a predetermined fixing cool down time elapses during the energy-saving state, of the heating rotating body and the pressing rotating body for a predetermined energy-saving state rotation time and then to cause the image forming apparatus to return to the energy-saving state, wherein the cumulative amount recording step also measures the amount of idle rotation caused by the energy-saving state rotation step for inclusion in the cumulative amount of the idle rotation.

17. The image forming method of claim 11, wherein when converted to represent idle rotation time, the predetermined allowable value is in a range of at least 30 minutes and at most 50 minutes.

18. The image forming method of claim 11, wherein when converted to represent idle rotation time, the predetermined allowable value is longer than the transition time.

19. The image forming method of claim 11, wherein the cumulative amount recording step resets the cumulative amount to zero when power is provided to the image forming apparatus.

20. The image forming method of claim 11, further comprising:

an input receiving step configured to receive input from a user to set whether to reset the cumulative amount when the image forming apparatus returns from the energy-saving state, wherein the setting step sets whether to reset the cumulative amount based on the input received by the input receiving step.

* * * * *